US006993813B2

(12) United States Patent
Kitagawa et al.

(10) Patent No.: US 6,993,813 B2
(45) Date of Patent: Feb. 7, 2006

(54) METHOD FOR MANUFACTURING A PIEZOELECTRIC/ELECTROSTRICTIVE FILM-TYPE ACTUATOR

(75) Inventors: Mutsumi Kitagawa, Nagoya (JP); Nobuo Takahashi, Owariasahi (JP); Yukihisa Takeuchi, Nishikamo-Gun (JP)

(73) Assignee: NGK Insulators, Ltd., Nagoya (JP)

( * ) Notice: Subject to any disclaimer, the term of this patent is extended or adjusted under 35 U.S.C. 154(b) by 19 days.

(21) Appl. No.: 10/886,452

(22) Filed: Jul. 7, 2004

(65) Prior Publication Data

US 2004/0244167 A1 Dec. 9, 2004

Related U.S. Application Data

(62) Division of application No. 10/156,729, filed on May 28, 2002, now Pat. No. 6,796,637.

(51) Int. Cl.
*H04R 17/00* (2006.01)
*B41J 2/045* (2006.01)

(52) U.S. Cl. ..... 29/25.35; 29/593; 29/831; 29/846; 29/890.1; 347/68

(58) Field of Classification Search ..... 29/25.35, 29/890.1, 831, 846, 593; 347/68, 71, 69, 347/72; 310/324, 328, 358
See application file for complete search history.

(56) References Cited

U.S. PATENT DOCUMENTS 4,237,606 A * 12/1980 Niwa et al. ..... 29/830
5,376,856 A * 12/1994 Takeuchi et al. ..... 310/328
5,475,279 A * 12/1995 Takeuchi et al. ..... 310/331
5,831,651 A * 11/1998 Usui et al. ..... 347/70
5,933,170 A * 8/1999 Takeuchi et al. ..... 347/71

OTHER PUBLICATIONS

U.S. Appl. No. 10/657,842, filed Sep. 9, 2003, Takeuchi et al.

* cited by examiner

*Primary Examiner*—A. Dexter Tugbang
*Assistant Examiner*—Tai Nguyen
(74) *Attorney, Agent, or Firm*—Burr & Brown

(57) ABSTRACT

A piezoelectric/electrostrictive film-type actuator has a ceramic base and a piezoelectric/electrostrictive element, which has piezoelectric/electrostrictive films and electrode films and which is disposed on the ceramic base, and is driven in accordance with a dislocation of the piezoelectric/electrostrictive element. The piezoelectric/electrostrictive element is formed such that the piezoelectric/electrostrictive films and the electrode films are alternately laminated so as to construct the uppermost layer and the lowermost layer with the electrode films. Also, the piezoelectric/electrostrictive films have two layers and no pores, containing a different phase formed by a decomposed material thereof, in the boundary sandwiched therebetween. In addition, the upper layer of the two-layered piezoelectric/electrostrictive films is thicker than the lower layer. This piezoelectric/electrostrictive film-type actuator solves the problem in that a withstand voltage of the piezoelectric/electrostrictive films is likely to decrease, and effectively achieves a bending dislocation.

3 Claims, 6 Drawing Sheets

METHOD FOR MANUFACTURING A PIEZOELECTRIC/ELECTROSTRICTIVE FILM-TYPE ACTUATOR

CROSS REFERENCE TO RELATED APPLICATION

This application is a division of U.S. application Ser. No. 10/156,729, filed May 28, 2002 now U.S. Pat. No. 6,796, 637, the entirety of which is incorporated herein by reference.

BACKGROUND OF THE INVENTION AND RELATED ART

The present invention relates to piezoelectric/electrostrictive actuators and methods for manufacturing the same. More particularly, it relates to a piezoelectric/electrostrictive film-type actuator which is used for a dislocation control device, a solid-state device motor, an ink-jet head, a relay, a switch, a shutter, a pump, a fin, and so on, which operates in response to a dislocation of an element and which serves as a transducer for converting mechanical energy into and from electrical energy, so as to achieve a quicker response, a higher energy conversion efficiency, and a larger bending dislocation, and it relates to methods for manufacturing the piezoelectric/electrostrictive actuator.

Piezoelectric/electrostrictive actuators which serve as a mechanism for increasing a pressure in a pressurized chamber formed in a base of the actuator and which change the volume of the pressurized chamber in response to a dislocation of a piezoelectric/electrostrictive element disposed on a wall of the pressurized chamber have been recently known. Such piezoelectric/electrostrictive actuators are used for, for example, an ink pump of a print head of an ink-jet printer and the like, for discharging an ink particle (ink droplet) from a nozzle communicating with the pressurized chamber by increasing the pressure in the pressurized chamber filled with ink in response to a dislocation of the piezoelectric/electrostrictive element, and thus for performing printing.

An example of an ink-jet print head using piezoelectric/electrostrictive actuators as shown in FIGS. 4 and 5 is disclosed in JP-A-06-40035.

An ink-jet print head 140 has an ink nozzle member 142 and a piezoelectric/electrostrictive actuator 145 integrally bonded with the nozzle member, and has a configuration in which ink fed in cavities 146 formed in the piezoelectric/electrostrictive actuator 145 is discharged from nozzles 154 formed in the ink nozzle member 142.

More particularly, the piezoelectric/electrostrictive actuator 145 has a ceramic base 144 and piezoelectric/electrostrictive elements 178 integrally formed with the ceramic base 144. The ceramic base 144 has a closing plate 166, a connecting plate 168, and a spacer plate 170 interposed between the closing plate and the connecting plate, these plates having a thin flat shape and being integrally formed.

The connecting plate 168 has first communication openings 172 and second communication openings 174 formed at positions corresponding to communication holes 156 and orifices 158, respectively, formed in an orifice plate 150. While the first communication opening 172 has substantially the same or a little larger inner diameter than that of the communication hole 156, the second communication opening 174 has a larger diameter than that of the orifice 158 by a predetermined amount.

Also, the spacer plate 170 has a plurality of long rectangular windows 176 formed therein. The spacer plate 170 is overlaid on the connecting plate 168 so that one of the first communication openings 172 and one of the second communication openings 174 formed in the connecting plate 168 are opened to the corresponding window 176.

Furthermore, the spacer plate 70 has the closing plate 166 and the connecting plate 168 overlaid on the respective surfaces thereof so that the closing plate 166 covers the windows 176. Thus, the ceramic base 144 has the cavities 146 formed therein which communicate with the outside via the first and second communication openings 172 and 174.

In such a piezoelectric/electrostrictive film-type actuator 145, in order to provide a larger dislocation so as to discharge a larger droplet, it is effective to make the closing plate 166 serving as upper walls as well as diaphragms of the cavities 146 thinner and also the short sides of the rectangular cavities 146 wider; however, this configuration leads to a decrease in the stiffness of the closing plate 166, resulting in a deterioration in the quick response of the actuator 145.

In order to increase the stiffness so as to achieve a quicker response, it is effective to make the closing plate 166 thicker and also the short sides of the long rectangular windows 176 (cavities 146) shorter; however, making the closing plate 166 thicker leads to thicker diaphragms, resulting in a small dislocation of the diaphragms, thereby causing a problem in that a required volume of a droplet is not discharged. In other words, it is difficult to achieve a large dislocation and a quick response, at the same time, of the piezoelectric/electrostrictive actuators by only optimizing the dimensions of the actuators when further improved performances of the actuators are required.

To solve these problems, the same applicant has proposed a piezoelectric/electrostrictive film-type actuator, in PCT Application No. PCT/JP02/02290, wherein piezoelectric/electrostrictive elements, each having a plurality of layers of piezoelectric/electrostrictive films and electrode films laminated therein, are disposed on a base. The proposed actuator is the same as a piezoelectric/electrostrictive film-type actuator 71, shown in FIG. 7, wherein a piezoelectric/electrostrictive element 78 having electrode films 73, 75, and 77 and a plurality of (i.e., two-layered) piezoelectric/electrostrictive films 79 laminated therein is disposed on a ceramic base 44 having a cavity 46 therein. When compared to a piezoelectric/electrostrictive element having a single-layered piezoelectric/electrostrictive film, the piezoelectric/electrostrictive element 78 increases a response speed because of its higher stiffness and also produces a larger force as a whole since the element 78 is driven by the plurality of piezoelectric/electrostrictive films, thereby achieving a relatively large dislocation despite its high stiffness. As a result, when the actuator is applied, for example, to an ink-jet print head, the actuator discharges a required volume of a droplet more quickly.

SUMMARY OF THE INVENTION

It is an object of the present invention to fully complement the foregoing proposal. That is to say, it has been found that when the proposed piezoelectric/electrostrictive element having a plurality of layers of piezoelectric/electrostrictive films and electrode films laminated therein is manufactured by firing all together after the piezoelectric/electrostrictive films and the electrode films are laminated, the upper surface of the piezoelectric/electrostrictive films, i.e., the piezoelectric/electrostrictive film in the uppermost layer is likely to be partially decomposed in firing, thereby causing different phases such as decomposed portions 80 illustrated in the piezoelectric/electrostrictive film-type actuator 71 shown in FIG. 7 to be produced, and leading to the likelihood of withstand voltage deterioration.

More particularly, for example, in PZT typically used as a piezoelectric material, Pb acting as a component of PZT and having a high vapor pressure property evaporates in firing, and thus a PZT crystal is decomposed, resulting in crater-like traces in which glass-like material (different from PZT) mainly including Zr and Ti resides. Since these portions have a reduced thickness of the piezoelectric/electrostrictive film and contain substances having different dielectric constants, the element is likely to have an electric field concentration during polarization or when a driving voltage is applied, thereby causing an electrical breakdown, that is, causing a problem of a reduced withstand voltage.

It has also been found that the piezoelectric/electrostrictive film in the lowermost layer closest to the ceramic base experiences an anti-shrinkage resistance most from the ceramic base (i.e., a closing plate) in firing shrinkage, and also experiences a heat stress most from the ceramic base (i.e., the closing plate) due to a difference in thermal expansion and shrinkage in cooling down after firing, thereby preventing the film in the lowermost layer from achieving its primary piezoelectric performance, and causing the film to have a reduced bending dislocation. The present invention is made in view of these problems.

Accordingly, it is an object of the present invention to solve the above-described problems, in other words, to provide a piezoelectric/electrostrictive film-type actuator which solves the problem of the likelihood of withstand voltage deterioration, and which effectively achieves a bending dislocation. Research focusing on the thickness of a plurality of piezoelectric/electrostrictive films constituting a piezoelectric/electrostrictive element has been conducted in order to solve the above problems and revealed that the above object can be achieved by the following means.

More particularly, the present invention provides a piezoelectric/electrostrictive film-type actuator which comprises a ceramic base and a piezoelectric/electrostrictive element disposed on the ceramic base, the element comprising piezoelectric/electrostrictive films and electrode films, the actuator being driven in accordance with a dislocation of the piezoelectric/electrostrictive element, characterized in that the piezoelectric/electrostrictive films and the electrode films are alternately laminated so as to construct the uppermost layer and the lowermost layer with the electrode films in the piezoelectric/electrostrictive element, and the piezoelectric/electrostrictive films have two layers and no pores, containing a different phase formed by a decomposed material thereof, in the boundary sandwiched therebetween, and the upper layer of the two-layered piezoelectric/electrostrictive films is thicker than the lower layer thereof.

In the present invention, the thickness $t_U$ of the upper-layered piezoelectric/electrostrictive film and the thickness $t_B$ of the lower-layered piezoelectric/electrostrictive film preferably satisfy at least one of the following expressions:

$$t_U \geqq t_B \times 1.1 \quad \text{(Numerical Expression 1)}$$

$$t_U \geqq t_B + 1\ (\mu\text{m}) \quad \text{(Numerical Expression 2).}$$

The piezoelectric/electrostrictive film-type actuator according to the present invention may have a structure in which the ceramic base has a cavity formed therein so as to be pressurized by deforming a diaphragm (i.e., the upper wall of the cavity) bonded to the piezoelectric/electrostrictive element in accordance with a dislocation of the piezoelectric/electrostrictive element. In this case, the thickness $t_W$ of the diaphragm, the thickness $t_U$ of the upper-layered piezoelectric/electrostrictive film, and the thickness $t_B$ of the lower-layered piezoelectric/electrostrictive film preferably satisfy the following expression (Numerical Expression 3), and the thickness $t_W$ of the diaphragm is preferably less than or equal to 50 m, more preferably from 3 to 12 am:

$$t_U + t_B \geqq 2 \times t_W \quad \text{(Numerical Expression 3).}$$

The above-described piezoelectric/electrostrictive film-type actuator according to the present invention is suitably applied to an ink pump of a print head of an ink-jet printer.

Additionally, in the piezoelectric/electrostrictive film-type actuator according to the present invention, the thickness of each layer of the upper-layered and lower-layered piezoelectric/electrostrictive films is preferably less than or equal to 15 $\mu$m, and more preferably from 3 to 10 $\mu$m. Also, at least one layer of the piezoelectric/electrostrictive films is more preferably formed by an electrophoretic method. Furthermore, at least two piezoelectric/electrostrictive elements are preferably disposed on a single ceramic base.

Moreover, when the piezoelectric/electrostrictive film-type actuator has a structure in which the ceramic base has the cavity formed therein so that the piezoelectric/electrostrictive element deforms the diaphragm so as to pressurize the cavity as described above, the ceramic base is preferably formed by integrally laminating a plurality of thin plates, and more preferably formed by integrally laminating two or three thin plates.

Next, the present invention provides a method for manufacturing a piezoelectric/electrostrictive film-type actuator, wherein the actuator has a ceramic base and a piezoelectric/electrostrictive element disposed on the ceramic base, the element has piezoelectric/electrostrictive films and electrode films, and the ceramic base has a cavity formed therein so as to be pressurized by deforming a diaphragm bonded to the piezoelectric/electrostrictive element in accordance with a dislocation of the piezoelectric/electrostrictive element. The method comprises a step A for forming a ceramic laminate by preparing at least one green sheet and one or more other green sheets having at least one hole formed therein, by laminating these sheets so as to form a green sheet laminate such that said at least one green sheet having no hole serves as the upper surface of the green sheet laminate, and by firing the green sheet laminate; a step B for forming the lower electrode film on the upper surface of the obtained ceramic laminate by a film forming method and for firing the lower electrode film; a step C for forming the lower-layered piezoelectric/electrostrictive film on the lower electrode film by the film forming method, for forming the middle electrode film on the lower-layered piezoelectric/electrostrictive film by the film forming method, and for forming the upper-layered piezoelectric/electrostrictive film, which is thicker than the lower-layered piezoelectric/electrostrictive film, on the middle electrode film by the film forming method; a step D for firing the laminated piezoelectric/electrostrictive films and the middle electrode film all together; and a step E for forming the upper electrode film on the upper-layered piezoelectric/electrostrictive film by the film forming method and for firing the upper electrode film.

In the method for manufacturing a piezoelectric/electrostrictive film-type actuator according the present invention, the thickness $t_U$ of the upper-layered piezoelectric/electrostrictive film and the thickness $t_B$ of the lower-layered piezoelectric/electrostrictive film preferably satisfy the foregoing expressions (i.e., at least one of Numerical Expressions 1 and 2).

Also, each layer of the piezoelectric/electrostrictive films and electrode films may be formed by applying the film forming method a plurality of times. The film forming method may be at least one thick film forming method selected from the group consisting of a screen printing method, a dipping method, a coating method, and an electrophoretic method. For example, the film forming method for the piezoelectric/electrostrictive films may comprise the screen printing method for the first time of film forming and the electrophoretic method for the following times of film forming.

The piezoelectric/electrostrictive film-type actuator manufactured by the method according to the present invention is suitably applied to an ink pump of a print head of an ink-jet printer.

BRIEF DESCRIPTION OF THE DRAWINGS

For a fully understanding of the nature and objects of the invention, reference should be made to the following detailed description of a preferred mode of practicing the invention, read in connection with the accompanying drawings in which.

DETAILED DESCRIPTION OF THE INVENTION

Figure 1:
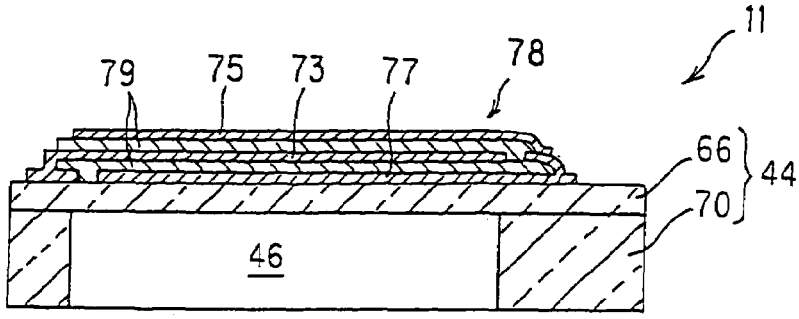
FIG. 1 is a sectional view of a piezoelectric/electrostrictive film-type actuator according to an embodiment of the present invention.

Although piezoelectric/electrostrictive film-type actuators and methods for manufacturing the same according to embodiments of the present invention will be described in detail, it should not be construed that the present invention be limited to these embodiments. Various changes, modifications, and improvements of the invention will be apparent to those skilled in the art without departing from the spirit of the present invention.

To begin with, the piezoelectric/electrostrictive film-type actuators according to the present invention will be described. Each of the piezoelectric/electrostrictive film-type actuators driven in response to a dislocation of a piezoelectric/electrostrictive element has a ceramic base and the piezoelectric/electrostrictive element disposed on the base, and the piezoelectric/electrostrictive element has piezoelectric/electrostrictive films and electrode films.

Each of the piezoelectric/electrostrictive film-type actuators according to the present invention is characterized in that the piezoelectric/electrostrictive element having two-layered piezoelectric/electrostrictive films is constructed such that the piezoelectric/electrostrictive films and the electrode films are alternately laminated so as to construct the uppermost and lowermost layers with the electrode films, in that the two-layered piezoelectric/electrostrictive films have no pores, containing a different phase formed by a decomposed material of the piezoelectric/electrostrictive films, in the boundary sandwiched therebetween, and also in that the upper layer of the two-layered piezoelectric/electrostrictive films is thicker than the lower layer.

By making the upper-layered piezoelectric/electrostrictive film thicker than the lower-layered piezoelectric/electrostrictive film, a sufficient insulating strength can be maintained even when decomposed portions exist, which are likely to occur when the upper-layered (thicker) piezoelectric/electrostrictive film is being fired. Also, since the lower-layered (thinner) piezoelectric/electrostrictive film close to the ceramic base (i.e., to a closing plate) experiences an anti-shrinkage resistance most from the ceramic base in firing shrinkage, or a heat stress most from the ceramic base due to a difference in thermal expansion and shrinkage in cooling down after firing, the lower-layered piezoelectric/electrostrictive film is prevented from achieving its primary piezoelectric performance and has a deteriorated performance compared to the upper-layered film; however, the lower-layered piezoelectric/electrostrictive film has a relatively increased electric field when driven because of its thin thickness, thereby compensating the deterioration in piezoelectric performance and accordingly achieving a large bending dislocation.

A preferable condition for the upper-layered film to be thicker than the lower-layered film is defined such that the thickness $t_U$ of the upper-layered piezoelectric/electrostrictive film and the thickness $t_B$ of the lower-layered piezoelectric/electrostrictive film satisfy the foregoing expressions (i.e., at least one of Numerical Expressions 1 and 2).

The piezoelectric/electrostrictive film-type actuators according to the present invention have a structure in which the ceramic base has cavities formed therein so that each cavity is pressurized by deforming a diaphragm bonded to the piezoelectric/electrostrictive element in accordance with a dislocation of the piezoelectric/electrostrictive element. The diaphragm acts as the upper wall of the cavity and is generally formed by the closing plate. In this case, the thickness $t_W$ of the diaphragm, the thickness $t_U$ of the upper-layered piezoelectric/electrostrictive film, and the thickness $t_B$ of the lower-layered piezoelectric/electrostrictive film preferably satisfy the foregoing expression (i.e., Numerical Expression 3). Also, the thickness $t_W$ of the diaphragm is preferably less than or equal to 50 $\mu$m, and more preferably from 3 $\mu$m to 12 $\mu$m.

Furthermore, each piezoelectric/electrostrictive film-type actuator according to the present invention has the thin film-like piezoelectric/electrostrictive elements in which each layer of the piezoelectric/electrostrictive films has a thickness of, for example, less than or equal to 15 $\mu$m (for further detailed exemplification, the upper layer has a thickness of 9 $\mu$m and the lower layer has a thickness of 8 $\mu$m). By laminating these films, when compared to a piezoelectric/electrostrictive element having a single piezoelectric/electrostrictive film and the same thickness per layer, the piezoelectric/electrostrictive element according to the present invention has a higher stiffness at the bending dislocation portion thereof, and accordingly achieves a quicker response. In addition, the element according to the present invention produces a larger force and thus achieves a relatively larger dislocation in spite of the higher stiffness thereof, since the two-layered piezoelectric/electrostrictive films are driven. Also, when compared to a piezoelectric/electrostrictive element having a single piezoelectric/electrostrictive film, the same overall thickness and a larger thickness per layer, the piezoelectric/electrostrictive element according to the present invention has a higher electric field intensity with the same driving voltage, and accordingly achieves a relatively larger dislocation and produces a relatively larger force.

Referring now to the drawings, the piezoelectric/electrostrictive film-type actuators according to the present invention will be described in detail.

Figure 2:
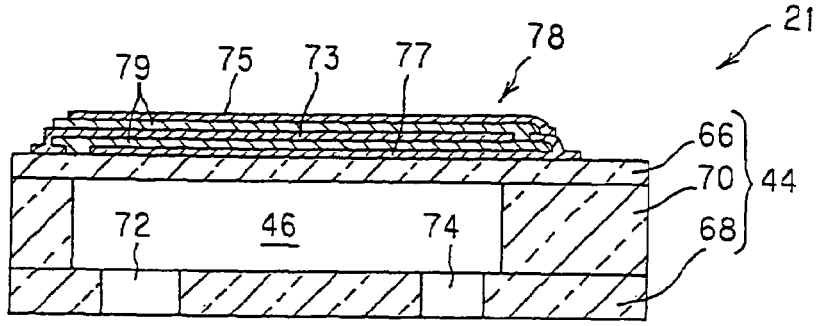
FIG. 2 is a sectional view of a piezoelectric/electrostrictive film-type actuator according to another embodiment of the present invention.
Figure 3:
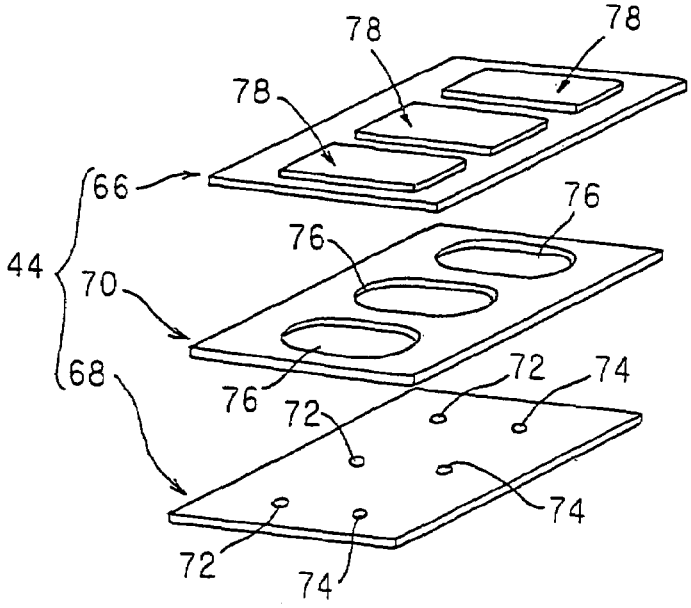
FIG. 3 is an exploded schematic view illustrating the structure of the piezoelectric/electrostrictive film-type actuator according to the present invention.
Figure 4:
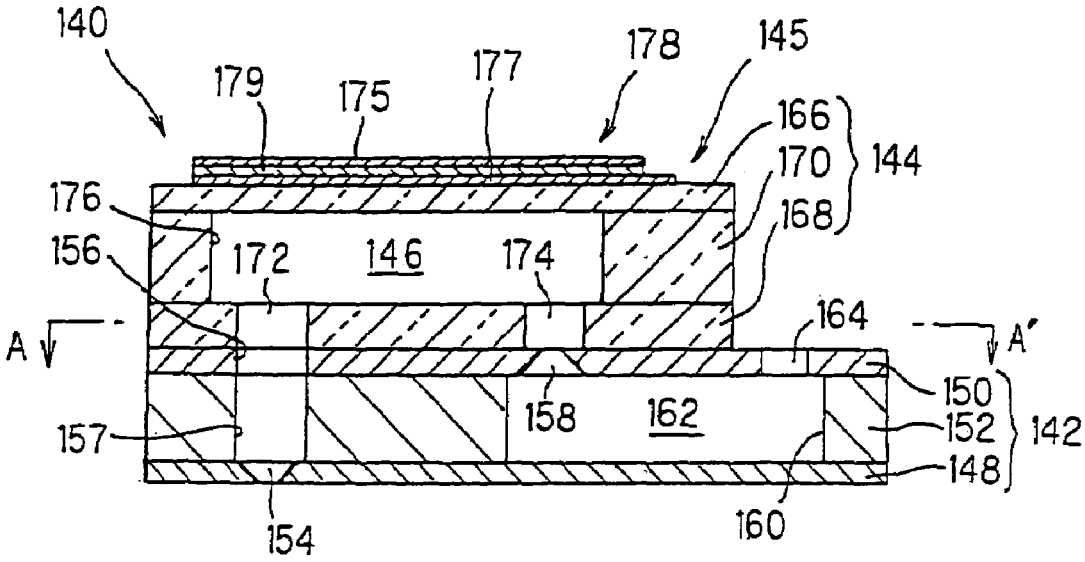
FIG. 4 illustrates a sectional view of a known actuator by way of example.
Figure 5:
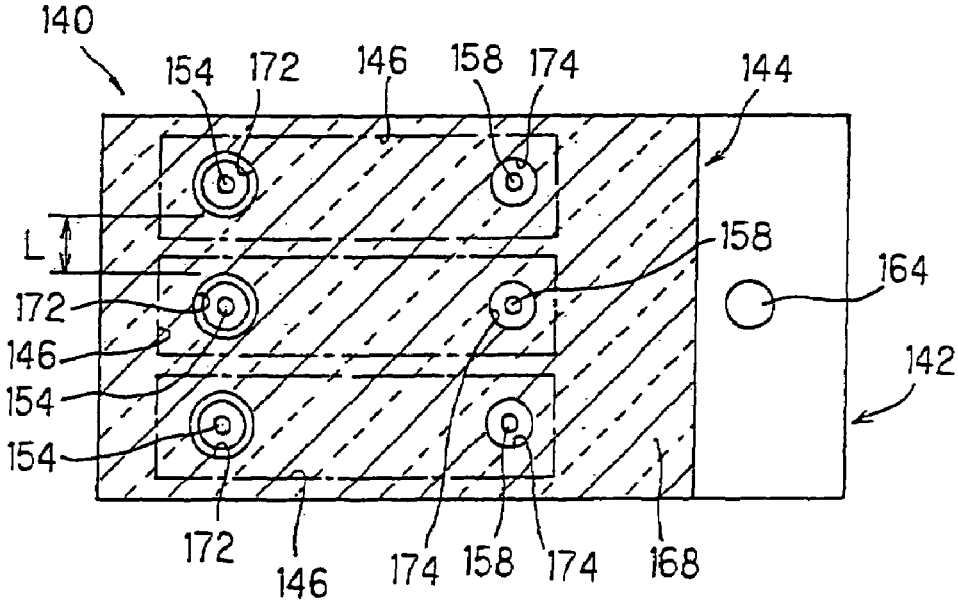
FIG. 5 is a sectional view of the known actuator taken along the line A–A' indicated in FIG. 4.
Figure 6:
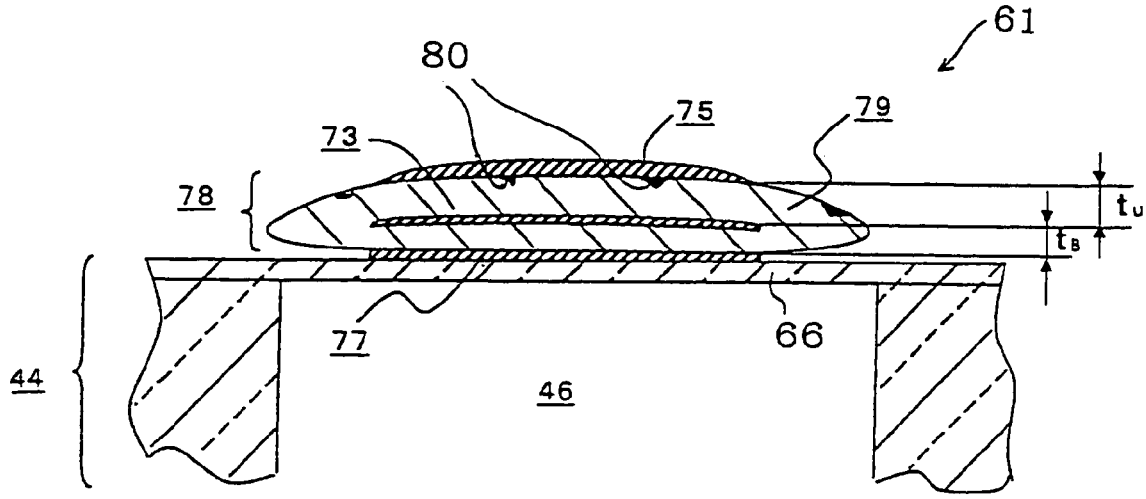
FIG. 6 is a sectional view of a piezoelectric/electrostrictive film-type actuator according to yet another embodiment of the present invention.
Figure 7:
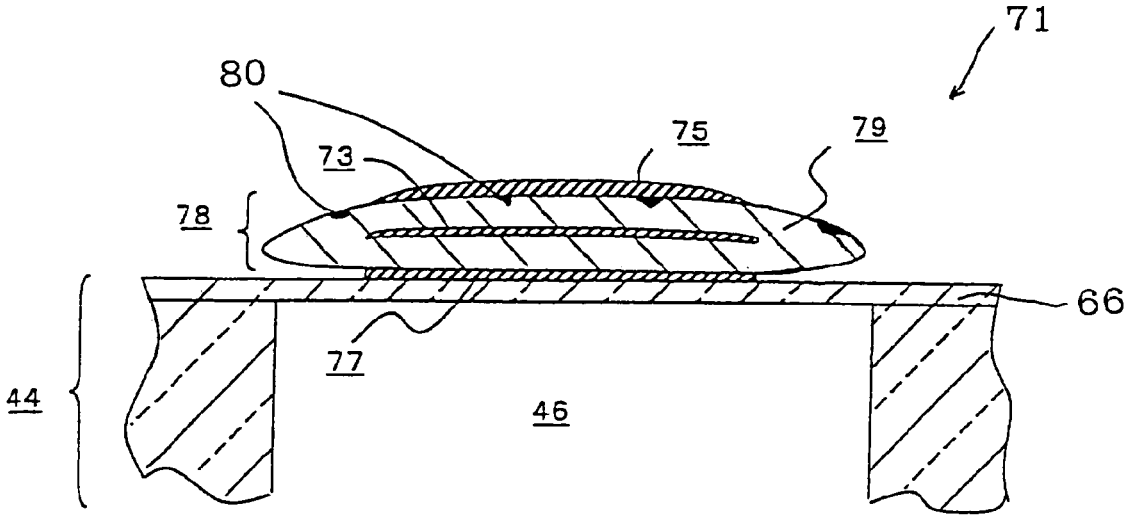
FIG. 7 illustrates a sectional view of another known actuator by way of example.

The piezoelectric/electrostrictive film-type actuators according to the embodiments will be described first. FIGS. 1, 2, and 6 are sectional views of the exemplary piezoelectric/electrostrictive film-type actuators according to the embodiments, and FIG. 3 is an exploded schematic view illustrating the structure of the piezoelectric/electrostrictive film-type actuator according to the present invention.

A piezoelectric/electrostrictive film-type actuator 21 shown in FIG. 2 has a ceramic base 44 and piezoelectric/electrostrictive elements 78 integrally formed with the ceramic base 44. The ceramic base 44 has a structure in which a thin flat closing plate 66, a thin flat connecting plate 68, and a thin flat spacer plate 70 interposed therebetween are superposed.

The connecting plate 68 has communication holes 72 and 74 formed therein. The spacer plate 70 has a plurality of openings 76, each having a substantially-rectangular horizontal cross-section as shown in FIG. 3. The spacer plate 70 is overlaid on the connecting plate 68 such that the communication holes 72 and 74 are opened to the corresponding opening 76.

The spacer plate 70 has the closing plate 66 and the connecting plate 68 superposed on the respective surfaces thereof so that the closing plate 66 covers the openings 76 formed in the spacer plate 70. Thus, the ceramic base 44 has a plurality of cavities 46 formed therein, each communicating with the outside via the communication holes 72 and 74 as shown in FIG. 2.

A piezoelectric/electrostrictive film-type actuator 11 shown in FIG. 1 has a structure in which the connecting plate 68 is omitted from the above-described piezoelectric/electrostrictive film-type actuator 21. That is, the piezoelectric/electrostrictive film-type actuator 11 has a base having two thin ceramic plates superposed therein while the piezoelectric/electrostrictive film-type actuator 21 has another base having three thin ceramic plates superposed therein.

Each of the piezoelectric/electrostrictive film-type actuators 11 and 21 has the plurality of piezoelectric/electrostrictive elements 78 on the upper surface of the closing plate 66 of the foregoing ceramic base 44, preferably corresponding to the plurality of cavities 46. Each piezoelectric/electrostrictive element 78 has a lower electrode film 77, a lower-layered piezoelectric/electrostrictive film 79, a middle electrode film 73, an upper-layered piezoelectric/electrostrictive film 79, which is thicker than the lower-layered film, and an upper electrode film 75, disposed on the closing plate 66 in that order, and the element is formed by a film forming method.

In the piezoelectric/electrostrictive film-type actuators 11 and 21 having the above-described structure, when an electric current is applied between the odd-numbered electrode films numbered from the bottom (i.e., the lower electrode film 77 and the upper electrode film 75) and the even-numbered electrode film (i.e., the middle electrode film 73) as in a conventional manner, an electric field is produced in each piezoelectric/electrostrictive film 79, causing an electric-field induced strain to be induced in the film 79. The lateral effect of the electric-field induced strain causes the ceramic base 44 to have a bending dislocation and a generative force produced therein in the vertical direction.

FIG. 6 is a sectional view of a piezoelectric/electrostrictive film-type actuator 61. The piezoelectric/electrostrictive film-type actuator 61 has the ceramic base 44 and the piezoelectric/electrostrictive element 78 integrally formed with the ceramic base 44 and is manufactured by a screen printing method. Because of the flowing nature of a piezoelectric/electrostrictive paste material in a screen printing process, the piezoelectric/electrostrictive element 78 becomes thinner while coming closer to the ends of the short sides of a pattern of the element. Also, similar to the piezoelectric/electrostrictive film-type actuators 11 and 21, the piezoelectric/electrostrictive film-type actuator 61 has the two-layered piezoelectric/electrostrictive films 79, and the upper-layered piezoelectric/electrostrictive film 79 is thicker than the lower-layered piezoelectric/electrostrictive film 79. A preferable relationship between the thickness $t_U$ of the upper-layered piezoelectric/electrostrictive film 79 and the thickness $t_B$ of the lower-layered piezoelectric/electrostrictive film 79 is to satisfy the foregoing expressions (i.e., at least one of Numerical Expressions 1 and 2), similarly in the piezoelectric/electrostrictive film-type actuators 11 and 21.

A configuration in which the upper-layered piezoelectric/electrostrictive film 79 is thicker than the lower-layered piezoelectric/electrostrictive film 79 is preferable on the following reasons. Firstly, a large insulating resistance can be maintained by making the upper-layered film thicker. Secondly, even when the lower-layered piezoelectric/electrostrictive film is prevented from achieving its primary piezoelectric performance and has a deteriorated performance, by making the lower-layered film thinner than the upper-layered film, the lower-layered piezoelectric/electrostrictive film has a larger electric field than the upper-layered film when the two films are driven together with the same driving voltage, compensating the deteriorated performance and accordingly achieving a larger bending dislocation.

As in the piezoelectric/electrostrictive film-type actuators 11, 21, and 61, a piezoelectric/electrostrictive element having a so-called high aspect ratio, in other words, the height in the vertical direction is greater than the width in the horizontal direction, can be easily formed by laminating the five-layered films in total including the two-layered piezoelectric/electrostrictive films 79. The piezoelectric/electrostrictive element having a high aspect ratio has a high stiffness at its bending dislocation portion and accordingly achieves a high response speed. Also, the element produces a large force as a whole and thus achieves a relatively large dislocation in spite of its high stiffness, since the plurality of piezoelectric/electrostrictive films is driven.

In the present invention, each actuator and each film constituting the actuator are formed and configured, not in an especially restrictive manner, but in any suitable manner as appropriate. The actuator may have a polygonal shape such as a triangle and a quadrangle, a round shape such as a circle and an ellipse, or a special shape such as a ladder shape. When the actuator is applied to an ink pump of a print head of an ink-jet printer, for example, pluralities of substantially rectangular cavities and piezoelectric/electrostrictive elements, both having respectively the same and substantially rectangular shapes, are preferably disposed at a regular interval in one direction in a single base.

Next, a shape, material and so forth of each component constituting the piezoelectric/electrostrictive film-type actuators according to the present invention will be described individually and specifically.

A ceramic base will be described first. In the piezoelectric/electrostrictive film-type actuator 21 shown in FIG. 2, the ceramic base 44 is a flexible substrate-like member, and deforms in response to a dislocation of the piezoelectric/electrostrictive element 78 disposed on the surface thereof, so that, for example, the cavity 46 deforms and has a pressure fluctuation produced therein. The shape and the material of the ceramic base 44 can be determined as appropriate, as long as the ceramic base has flexibility and a sufficient degree of mechanical strength so that the ceramic base is not broken due to its deformation.

In the ceramic base 44, the thickness of the closing plate 66, serving as an upper wall as well as a diaphragm of the cavity 46, is preferably less than or equal to 50 $\mu$m, more preferably from about 3 to 12 $\mu$m. Also, the thickness of the connecting plate 68 is preferably greater than or equal to 10 $\mu$m, more preferably greater than or equal to 50 $\mu$m. In addition, the thickness of the spacer plate 70 is preferably greater than or equal to 50 $\mu$m. The ceramic base is not limited to a rectangular shape, but may have a round shape or a polygonal shape, excluding a quadrangle shape, such as a triangle.

Preferable materials for the ceramic base are ceramics such as zirconia, alumina, magnesia, aluminum nitride, and silicon nitride. The most preferable materials are mainly formed from a fully stabilized zirconia and from a partially stabilized zirconia among the zirconia, since these materials have a large mechanical strength even when they are made thin, have a large toughness, and hardly react with the material of the piezoelectric/electrostrictive films.

Next, a piezoelectric/electrostrictive element will be described.

The piezoelectric/electrostrictive element comprises at least a piezoelectric/electrostrictive film and a pair of electrode films for applying a voltage on the piezoelectric/electrostrictive film. In the piezoelectric/electrostrictive film-type actuator 21 shown in FIG. 2, the piezoelectric/electrostrictive element comprises the two-layered piezoelectric/electrostrictive films 79, the lower electrode film 77, the middle electrode film 73, and the upper electrode film 75, wherein the upper-layered film is thicker than the lower-layered film, and the three electrode films sandwich the two-layered piezoelectric/electrostrictive films.

Although it is preferable to form the piezoelectric/electrostrictive elements 78 on an outer surface of the ceramic base 44 as in the piezoelectric/electrostrictive film-type actuator 21 shown in FIG. 2 since the elements can drive the corresponding cavities so as to have a large pressure fluctuation therein and can be easily manufactured, this configuration is not restrictive. The elements may be formed on inner surfaces of the cavities 46 in the ceramic base 44 or on both surfaces.

The piezoelectric/electrostrictive films are formed from any material as long as the material produces an electric-field induced strain such as a piezoelectric effect or an electrostrictive effect. The material can be selected as appropriate from a crystal or amorphous substance, and from semiconductor, ceramic, ferroelectric ceramic, and antiferroelectric ceramic.

Specific materials include ceramics containing, for example, lead zirconate, lead titanate, lead magnesium niobate, lead nickel niobate, lead zinc niobate, lead manganese niobate, lead antimony stannate, lead manganese tungstate, lead cobalt niobate, barium titanate, sodium bismuth titanate, bismuth neodymium titanate (BNT series), potassium sodium niobate, strontium bismuth tuntalate singly, in mixture, or in a form of solid solution. Preferable materials among others are mainly formed from lead zirconate titanate (PZT series), from lead magnesium niobate (PMN series), and from sodium bismuth titanate, since these materials have a large electromechanical coupling coefficient and a large piezoelectric constant, hardly react with the ceramic base when the piezoelectric/electrostrictive films are sintered, and achieve a stable composition.

The thickness of each layer of the piezoelectric/electrostrictive films is designed to be small, preferably less than or equal to 15 $\mu$m, and more preferably from about 3 to 10 $\mu$m, so as to achieve a large dislocation with a low voltage.

Preferable materials of the piezoelectric/electrostrictive films of the piezoelectric/electrostrictive element are highly conductive metals which are solid at room temperature and capable of withstanding exposure to a high-temperature oxidative atmosphere, e.g., to the degree of a firing temperature in a fabrication process of the element that will be described later. For example, one of, or an alloy of metals including aluminum, titanium, chromium, iron, cobalt, nickel, copper, zinc, niobium, molybdenum, ruthenium, palladium, rhodium, silver, tin, tantalum, tungsten, indium, platinum, gold, lead is used. Alternatively, a cermet material, formed by dispersing the same material as that of the piezoelectric/electrostrictive films or the ceramic base into the selected metals, may be used.

Since the thick electrode films cause the piezoelectric/electrostrictive element to have a significantly reduced dislocation, preferable materials of, for example, the upper electrode film 75 and the middle electrode film 73 in the piezoelectric/electrostrictive film-type actuator 21 according to the present invention shown in FIG. 2 are organic metal pastes, which provide a fine and thinner film after firing, such as a gold reginate paste, a platinum reginate paste, and a silver reginate paste.

The thickness of each piezoelectric/electrostrictive film is designed to be small, usually less than or equal to 15 $\mu$m, and more preferably less than or equal to 5 μm, so as to achieve a required amount of dislocation of the actuator.

Subsequently, methods for manufacturing the piezoelectric/electrostrictive film-type actuators according to the present invention will be described.

In the methods for manufacturing the piezoelectric/electrostrictive film-type actuators according to the present invention, the ceramic base is manufactured by a green-sheet laminating method, and the piezoelectric/electrostrictive element is manufactured by a film forming method. Reliability of the bonding between the ceramic base and the piezoelectric/electrostrictive element is essential since the reliability significantly affects the features of the actuators. In accordance with the green-sheet laminating method, since the ceramic base is formed integrally, the bonding portion of the ceramic base with the piezoelectric/electrostrictive element deteriorates little over time, thereby readily achieving a high reliability and a large stiffness of the bonding portion.

Taking the piezoelectric/electrostrictive film-type actuator 21 as an example, whose side sectional view is illustrated in FIG. 2, a method for manufacturing the ceramic laminate will be described first in further detail.

First, slurry is prepared by adding and mixing binder, solvent, dispersant, plasticizer and so forth into ceramic powder such as a zirconium oxide. Then, the slurry undergoes a defoaming treatment and then is made into a green sheet having a predetermined thickness by using the reverse roll coater method, the doctor blade method, or the like.

Next, the obtained green sheet is processed by a method such as punching with a metal die, or laser beam machining so as to provide a green sheet A which will be the closing plate 66 (see FIG. 3) after firing, a green sheet B which has at least one rectangular opening 76 and which will be the spacer plate 70 (see FIG. 3) after firing, and a green sheet C which has at least two communication holes 72 and 74 and which will be the connecting plate 68 (see FIG. 3) after firing. When the actuator is applied to, for example, an ink pump of a print head of an ink-jet printer, the communication holes 72 and 74, each communicating with the outside, have a substantially round cross section. The opening 76 in the green sheet B corresponds to the cavity 46 which will be formed later. By forming the plurality of openings 76, the plurality of actuators can be obtained at the same time.

Subsequently, the green sheet laminate is prepared by laminating at least one green sheet B, having at least one opening 76, between the green sheet A and the green sheet C. Then, the obtained green sheet laminate is fired at temperatures of, for example, about 1200 to 1600° C. so as to provide a ceramic laminate.

Subsequently, a method for manufacturing the piezoelectric/electrostrictive element will be described.

In the methods for manufacturing the piezoelectric/electrostrictive actuators according to the present invention, a thick film forming method such as a screen printing method, a dipping method, a coating method, or an electrophoretic method, or a thin film forming method such as an ion beam method, a spattering method, a vacuum deposition, an ion plating method, a chemical vapor deposition (CVD), or a plating method is applied for manufacturing the piezoelectric/electrostrictive element. By forming the piezoelectric/electrostrictive element on the upper surface of the ceramic laminate with at least one of the above methods, the piezoelectric/electrostrictive element is integrally bonded to and disposed on the ceramic base without using an adhesive agent, resulting in a high reliability. The thick film forming method is more preferably applied for manufacturing the piezoelectric/electrostrictive films, since the piezoelectric/electrostrictive films formed from paste, slurry, suspension, emulsion, sol, or the like, have excellent operating characteristics.

More specifically, by using, for example, the screen printing method, the lower electrode film 77 is printed at a predetermined position on the upper surface of the obtained ceramic laminate, and then is fired. Then, the lower-layered piezoelectric/electrostrictive film 79 is printed, the middle electrode film 73 is printed, the upper-layered piezoelectric/electrostrictive film 79 is printed so as to be thicker than the lower-layered film, in that order, and these films are fired at predetermined temperatures. Furthermore, the upper electrode film 75 is printed and fired so as to form the piezoelectric/electrostrictive element 78. Following this, electrode leads for connecting the piezoelectric/electrostrictive films to a drive circuit are printed and fired. Although the firing temperatures of the piezoelectric/electrostrictive films and the electrode films are determined as appropriate depending on the materials of these films, the temperatures range usually from 800 to 1400° C.

When the lower-layered piezoelectric/electrostrictive film 79 and the upper-layered piezoelectric/electrostrictive film 79 are independently fired, the lower-layered piezoelectric/electrostrictive film 79 has recesses containing different phases, in which the piezoelectric/electrostrictive material constituting the piezoelectric/electrostrictive films is decomposed, produced locally on the upper surface thereof, resulting in pores remaining therein. However, the pores containing the different phases, in which the piezoelectric/electrostrictive material is decomposed, can be avoided by firing the upper-layered and lower-layered piezoelectric/electrostrictive films 79 and the middle electrode film 73 all together in accordance with the present invention.

When the piezoelectric/electrostrictive film-type actuators according to the present invention are manufactured with the screen printing method, because of the flowing nature of a piezoelectric/electrostrictive paste material in a screen printing process, more specifically, as in the above-described piezoelectric/electrostrictive film-type actuator 61 shown in FIG. 6, the piezoelectric/electrostrictive element becomes thinner while coming closer to the ends of the short sides of the pattern of the element.

Figure 8:
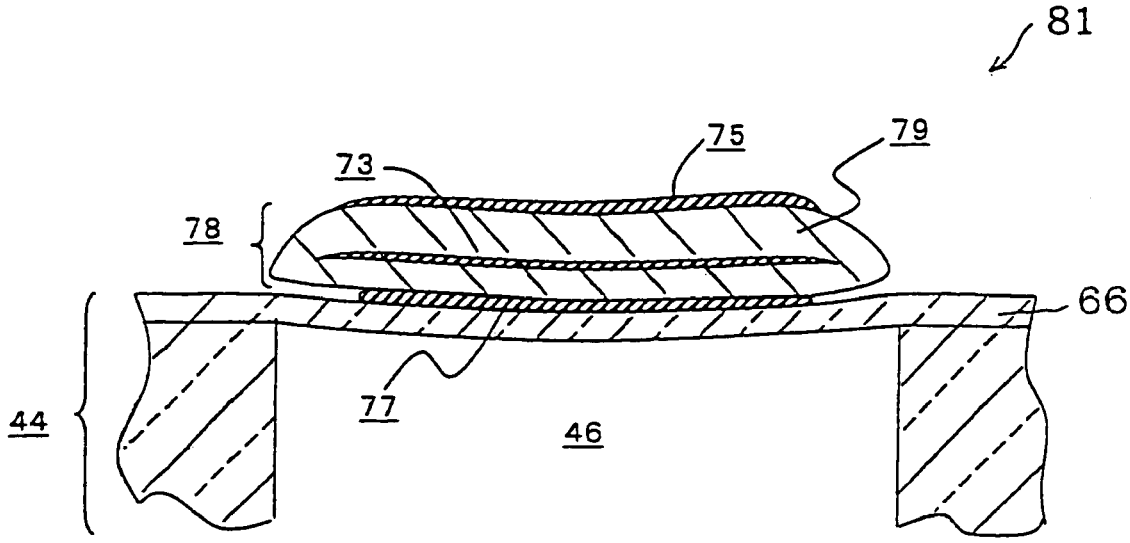
FIG. 8 is a sectional view, viewed from a short side of piezoelectric/electrostrictive films, illustrating an actual shape of another piezoelectric/electrostrictive film-type actuator according to the present invention by way of example.

Also, the piezoelectric/electrostrictive films 79 shrink in a direction perpendicular to the short sides thereof in a firing process of the piezoelectric/electrostrictive films 79, causing the closing plate 66 to sometimes have a convex shape at its middle portion toward the cavity 46 as shown in FIG. 8.

Figure 9:
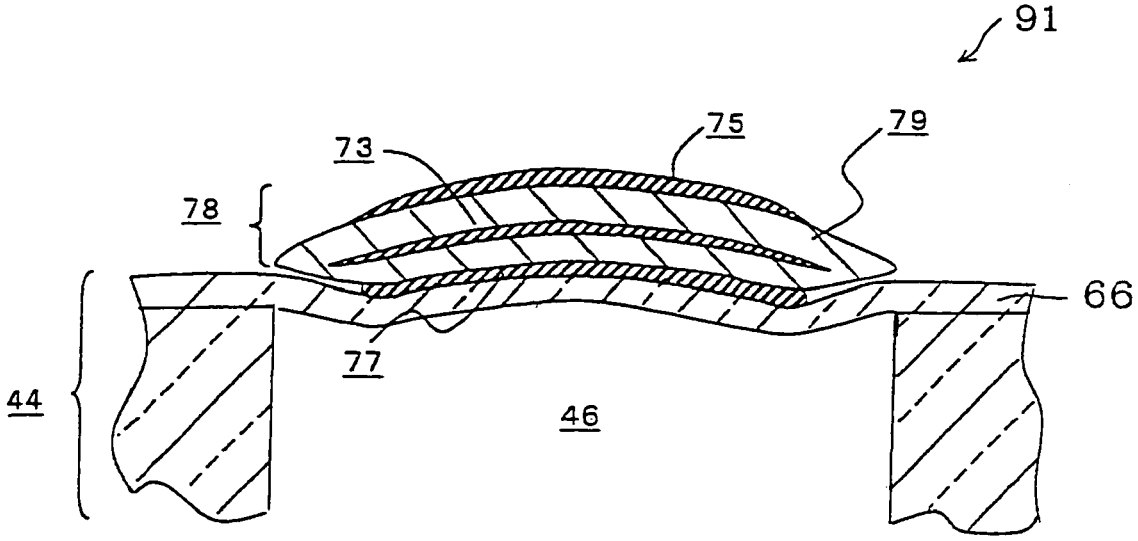
FIG. 9 is a sectional view, viewed from a short side of piezoelectric/electrostrictive films, illustrating an actual shape of another piezoelectric/electrostrictive film-type actuator according to the present invention by way of example.

By adjusting start times and amounts of firing shrinkage of the upper and lower piezoelectric/electrostrictive films 79, and also a shape of the closing plate 66, the closing plate 66 has a W-shape as shown in FIG. 9. The piezoelectric/electrostrictive films with such a shape achieve a bending dislocation more easily than those with a simple shape shown in FIG. 8. Although it is not known exactly why this takes place, one possibility is assumed such that the piezoelectric/electrostrictive films are likely to release strains produced therein when the films are subject to firing shrinkage, causing residual stresses which deteriorate the characteristics of the piezoelectric/electrostrictive material to decrease.

Figure 10:
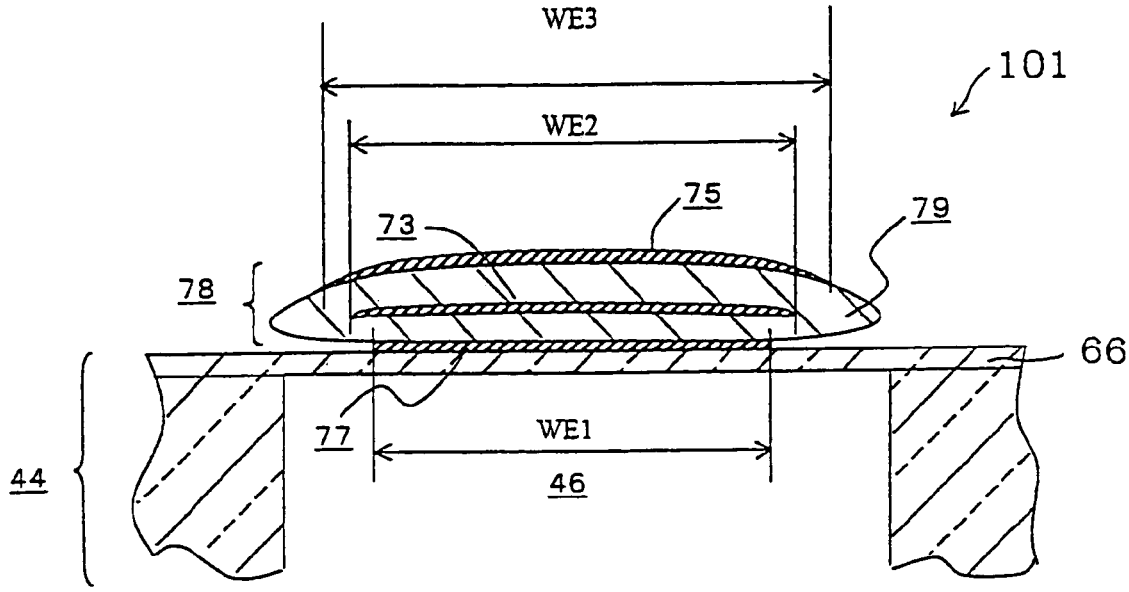
FIG. 10 is a sectional view, viewed from a short side of piezoelectric/electrostrictive films, illustrating an actual shape of another piezoelectric/electrostrictive film-type actuator according to the present invention by way of example.

When the piezoelectric/electrostrictive films 79 have small short sides; i.e., 200 μm or less, by making the widths of the electrode films larger film by film from the bottom to the top as shown in FIG. 10 (i.e., WE1<WE2<WE3 in FIG. 10), the upper-layered piezoelectric/electrostrictive film is deflected larger than the lower-layered piezoelectric/electrostrictive film, thereby improving a bending efficiency and achieving a bending dislocation more effectively. It is desirable to optimize enlarged amounts of the widths in consideration of the electric field distribution, and, for example, the enlarged amount is preferably about two times the thickness of the upper-layered or lower-layered piezoelectric/electrostrictive film 79.

Figure 11:
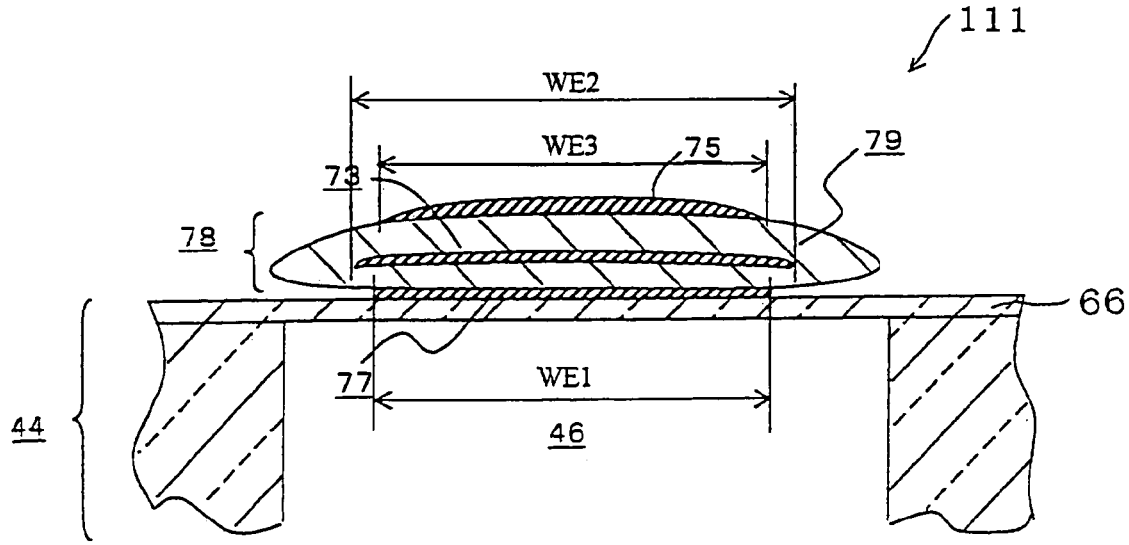
FIG. 11 is a sectional view, viewed from a short side of piezoelectric/electrostrictive films, illustrating an actual shape of another piezoelectric/electrostrictive film-type actuator according to the present invention by way of example.
Figure 12:
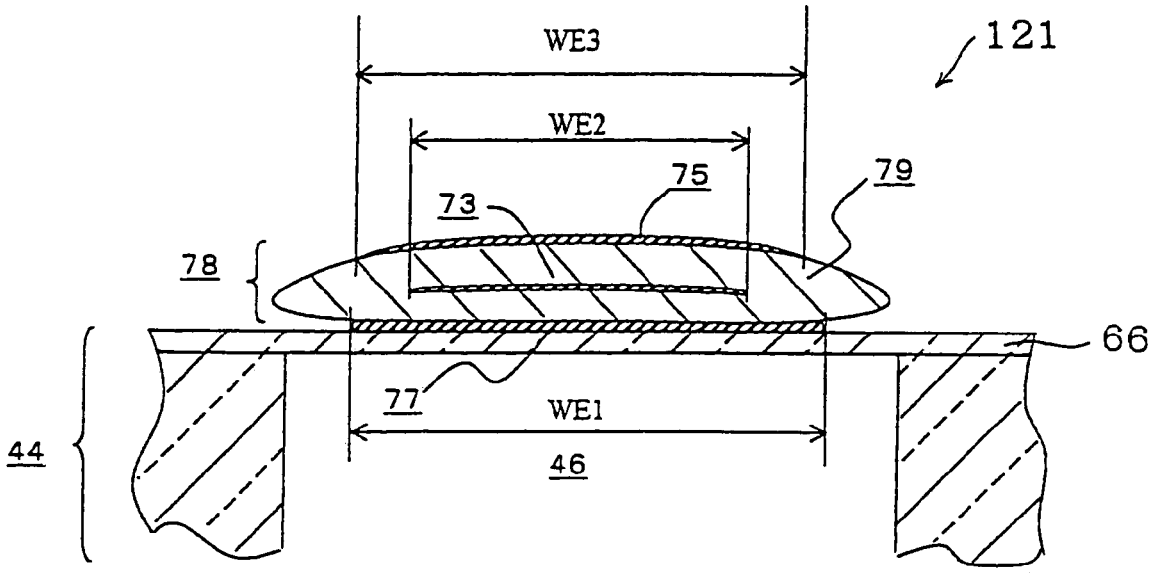
FIG. 12 is a sectional view, viewed from a short side of piezoelectric/electrostrictive films, illustrating an actual shape of another piezoelectric/electrostrictive film-type actuator according to the present invention by way of example.

When achieving a large bending dislocation by increasing the driving voltage of the piezoelectric/electrostrictive film-type actuator, it is desirable to change the width of the electrode film 73 so as to be different from those of the electrode films 75 and 77 as shown in FIGS. 11 and 12 (i.e., WE1, WE3<WE2 in FIG. 11, and WE2<WE1, WE3 in FIG. 12). This arrangement prevents an electric field from being produced in the vicinity of the ends of the short sides of the piezoelectric/electrostrictive films 79, wherein the films become thinner while coming closer to the ends.

As described above, each piezoelectric/electrostrictive film-type actuator provided by the present invention has two-layered piezoelectric/electrostrictive films, no laminated structure bonded by an adhesive agent, and so forth, achieving a large dislocation with the same driving voltage, a higher response speed, a larger generative force, and excellent characteristics. In addition, by making the upper-layered piezoelectric/electrostrictive film of the two-layered films thicker, the actuator maintains a large insulating resistance so as to improve the reliability over a long period of time. Furthermore, even when the upper-layered piezoelectric/electrostrictive film is prevented from achieving its primary bending dislocation, by making the lower-layered piezoelectric/electrostrictive film thinner than the upper-layered film, the lower-layered film has a larger driving electric field than the upper-layered piezoelectric/electrostrictive film when driven with a single driving voltage together with the upper-layered film, and has a relatively larger bending dislocation, consequently solving the problems of the actuator which has two-layered piezoelectric/electrostrictive films and which is achieved by firing these films together.

The piezoelectric/electrostrictive film-type actuators according to the present invention are applied to a dislocation control device, a solid-state device motor, an ink-jet head, a relay, a switch, a shutter, a pump, a fin, and so on, and are suitable for an ink pump of a print head of an ink-jet printer.

What is claimed is:

1. A method for manufacturing a piezoelectric/electrostrictive film-type actuator, the actuator comprising a ceramic base and a piezoelectric/electrostrictive element disposed on the ceramic base, wherein the element includes piezoelectric/electrostrictive films and electrode films, and wherein the ceramic base includes a cavity formed therein so as to be pressurized by deforming a diaphragm bonded to the piezoelectric/electrostrictive element in accordance with a dislocation of the piezoelectric/electrostrictive element, the method comprising:

forming a ceramic laminate by preparing at least one green sheet and at least one other green sheet having at least one hole formed therein, by laminating these sheets so as to form a green sheet laminate such that said at least one green sheet having no hole serves as the upper surface of the green sheet laminate, and by firing the green sheet laminate;

forming a lower electrode film on the upper surface of the ceramic laminate by a film forming method and firing the lower electrode film;

forming a lower-layered piezoelectric/electrostrictive film on the lower electrode film by the film forming method, forming a middle electrode film on the lower-layered piezoelectric/electrostrictive film by the film forming method, and forming an upper-layered piezoelectric/electrostrictive film, which is thicker than the lower-layered piezoelectric/electrostrictive film, on the middle electrode film by the film forming method;

firing the piezoelectric/electrostrictive films and the middle electrode film all together; and forming an upper electrode film on the upper-layered piezoelectric/electrostrictive film by the film forming method and firing the upper electrode film.

2. The method for manufacturing a piezoelectric/electrostrictive film-type actuator according claim 1, wherein the thickness $t_U$ of the upper-layered piezoelectric/electrostrictive film and the thickness $t_B$ of the lower-layered piezoelectric/electrostrictive film satisfy at least one of the following expressions:

$$t_U \geqq t_B \times 1.1 \text{ and } t_U \geqq t_B + 1 \ (\mu\text{m}).$$

3. The method for manufacturing a piezoelectric/electrostrictive film-type actuator according claim 1, wherein the film forming method is at least one thick film forming method selected from the group consisting of a screen printing method, a dipping method, a coating method, and an electrophoretic method.

* * * * *

UNITED STATES PATENT AND TRADEMARK OFFICE

CERTIFICATE OF CORRECTION

PATENT NO. : 6,993,813 B2 
DATED : February 7, 2006
INVENTOR(S) : Mutsumi Kitagawa, Nobuo Takahashi and Yukihisa Takeuchi It is certified that error appears in the above-identified patent and that said Letters Patent is hereby corrected as shown below:

Title page,
Item [56], References Cited, add the following:
-- U.S. PATENT DOCUMENTS

| | | |
|---|---|---|
| 6,437,484 B1 | 08/2002 | Nishimura et al. |
| 6,142,615 | 11/2000 | Qiu et al. |
| 6,497,019 B1 | 12/2002 | Yun |
| 6,347,441 B1 | 02/2002 | Yun et al. |
| 6,504,287 B2 | 01/2003 | Yun et al. |

FOREIGN PATENT DOCUMENTS

| | | |
|---|---|---|
| JP | 06-040035 A1 | 02/1994 |
| WO | 02/073710 A1 | 09/2002 --. |

Signed and Sealed this

Twenty-third Day of May, 2006

JON W. DUDAS
*Director of the United States Patent and Trademark Office*